United States Patent [19]

Zoller

[11] Patent Number: 4,931,605

[45] Date of Patent: Jun. 5, 1990

[54] MULTI-POLE SWITCH

[75] Inventor: Jon P. Zoller, Prior Lake, Minn.

[73] Assignee: ITT Corporation, New York, N.Y.

[21] Appl. No.: 390,141

[22] Filed: Aug. 7, 1989

[51] Int. Cl.[5] ..... H01H 5/14

[52] U.S. Cl. ..... 200/408; 200/406

[58] Field of Search ..... 200/407, 408, 409, 405, 200/406, 243

[56] References Cited

U.S. PATENT DOCUMENTS

| | | | |
|---|---|---|---|
| 2,036,295 | 4/1936 | Piffath | 200/407 |
| 3,783,205 | 1/1974 | Boulanger | 200/5 |
| 4,004,121 | 1/1977 | Twyford | 200/275 |
| 4,336,429 | 6/1982 | Jackson et al. | 200/408 |
| 4,391,845 | 7/1983 | Denley | 427/58 |
| 4,484,042 | 11/1984 | Matsui | 200/406 |
| 4,587,387 | 5/1986 | Piguet | 200/407 |

FOREIGN PATENT DOCUMENTS

| | | | |
|---|---|---|---|
| 2736172 | 2/1979 | Fed. Rep. of Germany | 200/407 |

*Primary Examiner*—Henry J. Recla
*Assistant Examiner*—Keith Kupferschmid
*Attorney, Agent, or Firm*—Thomas L. Peterson

[57] ABSTRACT

A multi-pole switch is provided which has a large air gap between contacts in the open state, and which requires medium to high actuating forces while providing tactile feedback to indicate that full actuation has occurred. The switch includes a pair of sheet metal shorting contacts (22, 24, FIG. 2) each extending in a largely rectangular loop, with one long side (26) and the opposite short sides (30, 32) forming a clamped outer region (34), and with the other long side forming a beam (28) that can be deflected down towards a pair of fixed switch contacts (50, 52). The outer region (34) is deflected so the beam (28) is upwardly bowed. The beam includes a main beam portion (36) and fingers (46, 48) extending from it, the fingers being deflected against the switch contacts when the main beam portion is deflected. Bowing can be facilitated by a third switch contact (70) lying under the other long side (26) of the shorting contact. An actuator (12, FIG. 3) includes a plunger (56) with a pair of bosses (60, 62) lying near opposite sides of the main beam portion of each shorting contact. A snapdome (100) lies over the plunger to provide tactile feedback, and an elastomeric button (110) lies over the snapdome.

15 Claims, 4 Drawing Sheets

FIG. 3
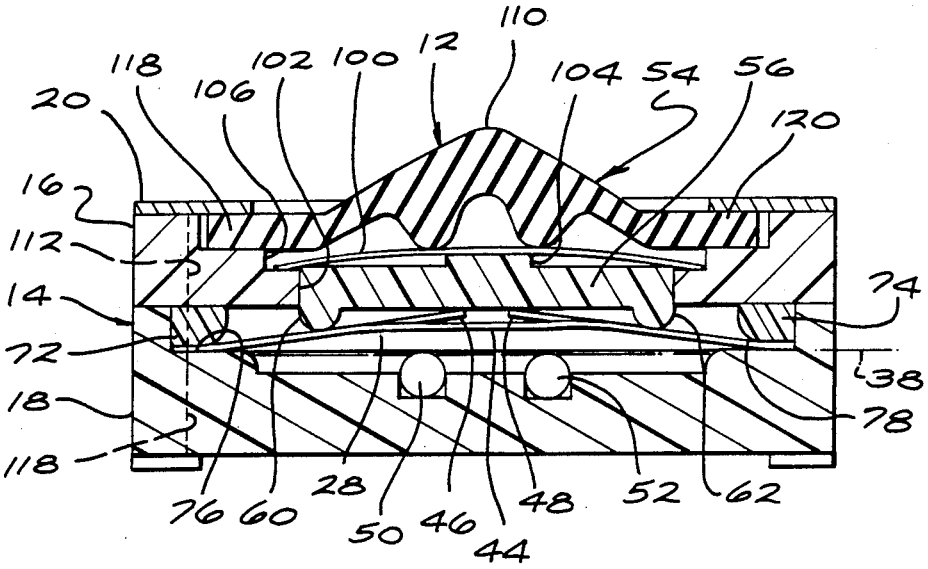
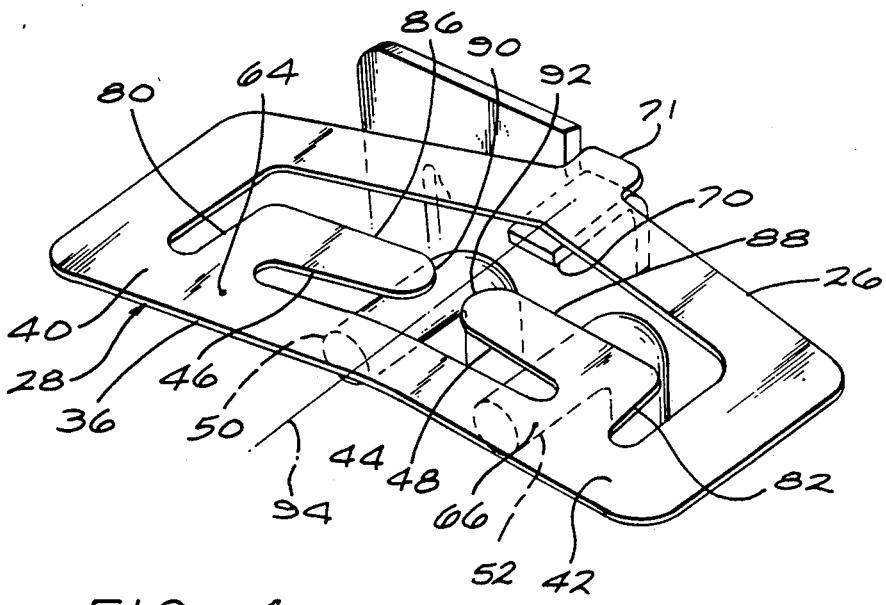
FIG. 4

MULTI-POLE SWITCH

BACKGROUND OF THE INVENTION

Small and low cost multi-pole switches are useful in a variety of applications, such a on avionics panels. However, few low profile multi-pole switches are available, and they are complex and costly. This has limited the usage of multi-pole flat panel switches. Such multi-pole switches are useful to input data into backup systems and for redundant contact switches for secure contact integrity. Multi-pole switches of low profile and low cost, which also provided good tactile feedback and provided large air gaps between contacts in the open position, would be of considerable value.

SUMMARY OF THE INVENTION

In accordance with one embodiment of the present invention, a multi-pole switch is provided which is of low profile and low cost. The switch includes a housing and at least one sheet metal shorting contact with an outer region that includes a pair of opposite end portions, and a beam extending between the end portions. The outer region is clamped to the housing to hold the beam in an upwardly bowed configuration. The beam includes a pair of fingers lying over a pair of switch contacts in the housing. An actuator with a pair of bosses lying over the upwardly-bowed beam can deflect beam locations to move the fingers down against the switch contacts.

The shorting contact extends in a largely rectangular loop, and includes a long side opposite the beam. A third switch contact lies under the long side to contact the shorting contact and help keep it in a bowed configuration. Each of the fingers of the beam has an inner end mounted near a different end of the main beam portion, and each finger extends toward the other. As a result, the fingers lie further from the switch contacts than the middle of the main portion, to provide a larger air gap in the open switch position. The actuator includes a plunger with bosses that can depress locations along the beam near its opposite ends, thereby providing more deflection at the fingers than if the beam were depressed at its center. The plunger is depressible by a snapdome to provide resistance to closure and to provide tactile feedback. An elastomeric button lying over the snapdome, seals the switch components and provides additional resistance to actuation.

The novel features of the invention are set forth with particularly in the appended claims. The invention will be best understood from the following description when read in conjunction with the accompanying drawings.

BRIEF DESCRIPTION OF THE DRAWINGS

FIG. 3 is a sectional view of the complete switch taken on the line 3—3 of FIG. 2.

FIG. 4 is a partial perspective view of a shorting contact of FIG. 2.

DESCRIPTION OF THE PREFERRED EMBODIMENT

Figure 1:
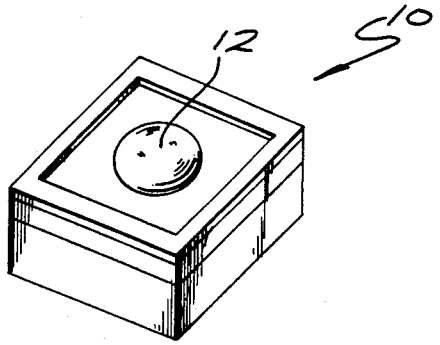
FIG. 1 is a perspective view of a switch constructed in accordance with the present invention.
Figure 2:
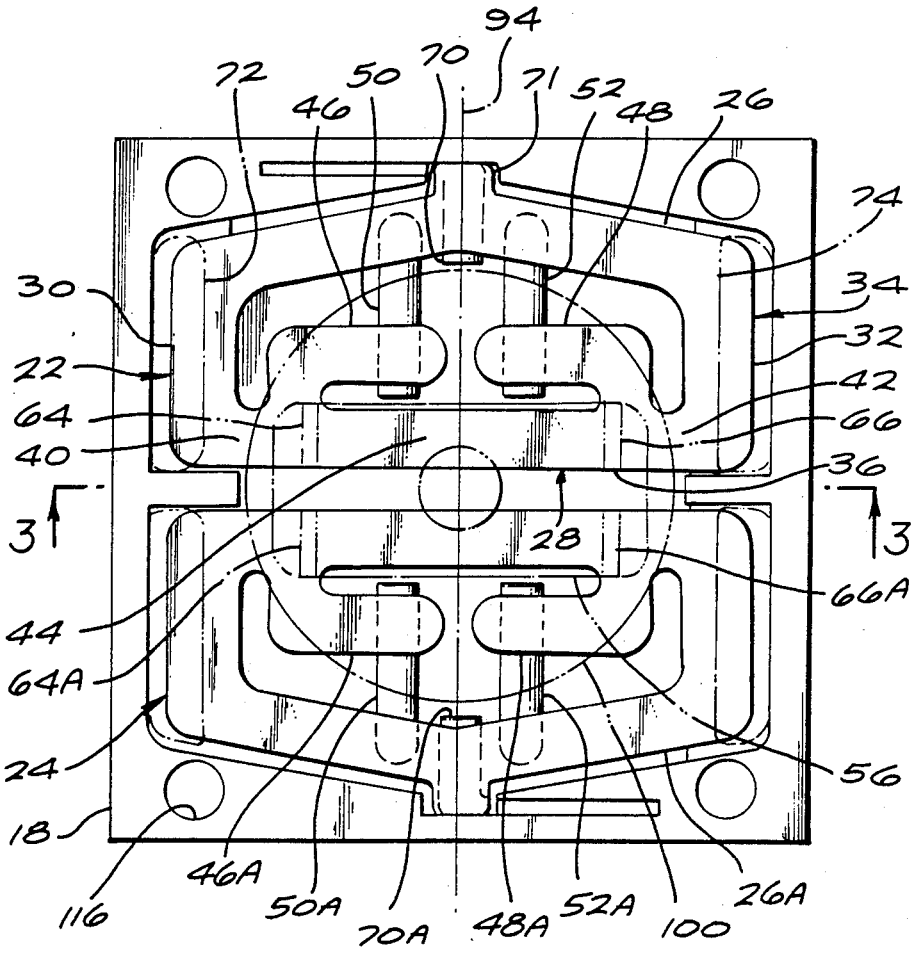
FIG. 2 is a plan view of the switch of FIG. 1, with the actuator and upper housing removed.
Figure 5:
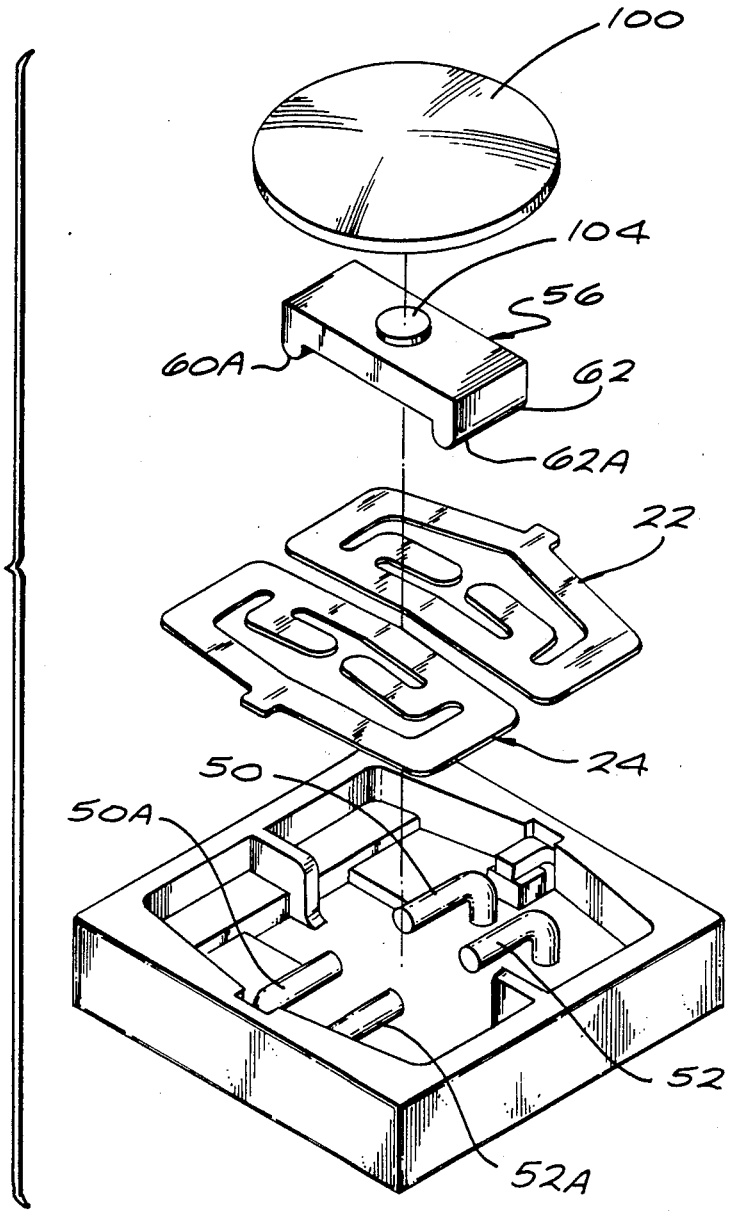
FIG. 5 is an exploded perspective view of a portion of the switch of FIG. 3.
Figure 6:
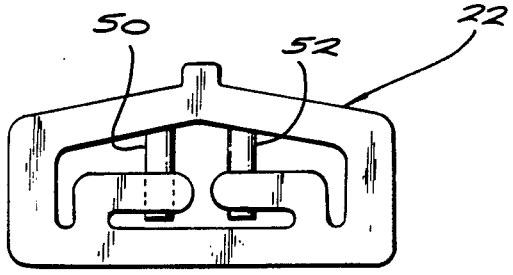
FIG. 6 is a plan view of the contact element of FIG. 4.
Figure 7:
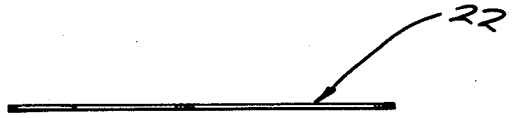
FIG. 7 is a side view of the contact element of FIG. 6 in the unmounted, unstressed position.

FIG. 1 illustrates a push-button switch 10 which includes a button 12 that can be depressed to close the switch. As shown in FIG. 3, the switch includes a housing 14 with upper and lower housing portions 16, 18 and with a retainer 20. As also shown in FIG. 2, the switch includes a pair of shorting contacts 22, 24 that are substantially identical. The shorting contact 22 extends in a somewhat rectangular loop, with opposite long side portions or sides 26, 28 joined by opposite end portions 30, 32. Three of the elongated portions 26, 30, and 32 form an outer region 34 that is clamped down to the lower housing portion, while the long side portion 28 forms a free beam that is free to bend up and down. The outer region 34 of side or beam 28 is held so that the beam 28 is normally (in the open switch position) in an upwardly bowed configuration. That is, the beam 28 is held with its middle 44 above the ends of the beam when the shorting contact 22 lies in a substantially horizontal plane 38 with the button 12 above the shorting contact. It should be noted that switch can be used in any orientation, and the terms "up" and "down" are used only to aid in the description.

The long side portion or beam 28 of the shorting contact includes a main beam portion 36 with opposite beam ends 40, 42 joined to the short sides or end portions 30, 32, and a middle 44 halfway between the ends. The beam also includes a pair of fingers 46, 48 extending from the main beam portion 36. A pair of switch contacts 50, 52 each lie under one of the fingers 46, 48. An actuator or actuator assembly 54 (FIG. 3) includes a plunger 56 with a pair of bosses 60, 62 which lie over locations 64, 66 (FIG. 3) on the beam 28, that are on opposite sides of the beam middle 44. The actuator can be depressed to move down the plunger and its bosses 60, 62, to move down the fingers 46, 48 against the switch contacts 50, 52.

The switch includes an additional switch contact 70 (FIG. 2) which lies under and against the bottom surface of the shorting contact 22 at the middle of its long side portion 26 which has a locating tab 71. The housing includes a pair of clamps 72, 74 in the form of bars that press the opposite end portions 30, 32 of the shorting contact down against, or almost against a support surface or surfaces 76 of the lower housing portion. The combination of the third switch contact 70 that lies above an imaginary line connecting the opposite end portions 30, 32 and the clamp bars that hold down the end portions of the contact, results in the long side portion 26 being upwardly bowed. The bowing stresses are coupled through the ends 30, 32 of the contact to the beam 28 to cause it also to bow. The inner edges 78 of the clamps 72, 74 are rounded to avoid interference with bowing of the beam 28.

The long side or beam 28 of the shorting contact is formed so the fingers 46, 48 each have an inner end 80, extending from a location on the beam which is closer to a corresponding end 40, 42 of the beam than to the middle 44 of the beam. Each finger also has an outer portion 86, 88 extending primarily parallel to the main beam portion 36, and with the outer portions 86, 88 extending towards each other with their extreme outer ends 90, 92 lying close to an imaginary line 94 extending through the middle 44 of the beam and the middle of the long side portion 26 of the contact assembly. When the beam locations 64, 66 are depressed, the fingers travel a considerable distance before they engage the switch contacts 50, 52, so there is a large air gap between the fingers and switch contacts when the switch is open.

Figure 8:
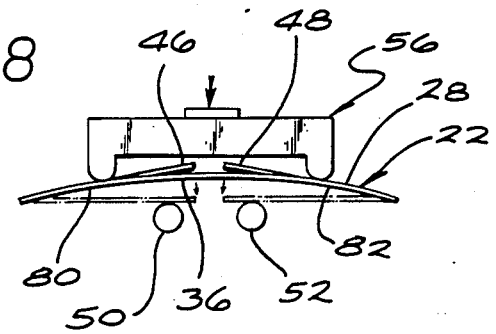
FIG. 8 is a side elevation view of the contact elements of FIG. 7 in the mounted but open switch position, shown with the plunger and switch contacts.

FIG. 8 illustrates the manner in which the beam 28 of the shorting contact 22 is oriented in the open state. While the main beam portion 36 is smoothly bowed, the fingers 46, 48 extend substantially tangent to the main beam portion 36 at the inner ends 80, 82 of the fingers where they join to the main beam portion. As a result, the outer portions of the fingers lie further away from the fixed switch contacts 50, 52 than the main beam portion 36. In this way, there is greater travel of the fingers before they touch the switch contacts 50, 52.

The actuator assembly 54 (FIG. 3) includes the elastomeric button 12, a snapdome 100 immediately under the button 12, and the plunger 56 which lies immediately under the snapdome. The plunger is guided in vertical movement by the walls of a hole 102 in the upper housing portion 16. The plunger has an upstanding boss 104 which is round as seen in a plan view, and that lies against the middle of the snapdome 100 which is the most resilient part of the snapdome. The snapdome 100 is a deformed piece of sheet metal whose center resists depression with a force that suddenly falls as the snapdome "snaps" past a certain position. Such snapdomes are well known for use where they directly engage a contact. Applicant uses a snapdome to provide resistance to operation of the switch, and also to provide tactile feedback (including a "click" sound) so the person knows when he has closed the switch and does not have to apply excessive force to be sure. The periphery of the snapdome is surrounded by the walls of a groove 106 in the upper housing portion 16.

As the switch is closed, the fingers 46, 48 engage the switch contacts 50, 52 before full depression of the main beam portion 36. This provides for wiping contact of the fingers against the switch contact. It also assures that before or at the time when the snapdome snaps, the fingers 46, 48 will firmly contact the switch contacts.

The button 12 is of elastomeric material such as rubber and provides a sealing function in conjunction with the retainer 20. The button has a raised middle portion 110 which is depressed to actuate the switch. When the middle portion is depressed it behaves as a rubber spring. As the button is progressively loaded against the snap dome, the button produces a force great enough to cause the snap dome to actuate. This compression of the button, with the deflection of the snap dome, increases the apparent switch pretravel from approximately 0.012 inch of the snap dome alone, to approximately 0.040 inch of the complete assembly. Moreover, the resilient nature of the button provides limited overtravel protection in the event that the external actuating member is overloaded. It may be noted that where additional resistance to actuation is desired, an additional snap dome can be used on top of the one shown.

The retainer 20 has prongs 112 that fit into holes 116 of the housing to keep the parts together. A groove 118 which receives a flange 120 at the periphery of the button, is slightly shallower than the button flange. As a result, the retainer 20 presses the peripheral flange of the button to provide a water resistant seal for the workings of the switch.

As discussed above, the switch includes not only the shorting contact 22, but includes a second shorting contact 24 (FIG. 2). The second shorting contact 24 is substantially identical to the first contact 22, and it also includes a pair of fingers 46A, 48A that are deflected against a pair of fixed or switch contacts 50A, 52A when locations 64A, 66A are depressed by bosses 60A, 62A on the plunger. The second contact 24 also has a long side portion 26A that is pressed up by a third switch contact 70A.

Figure 9:
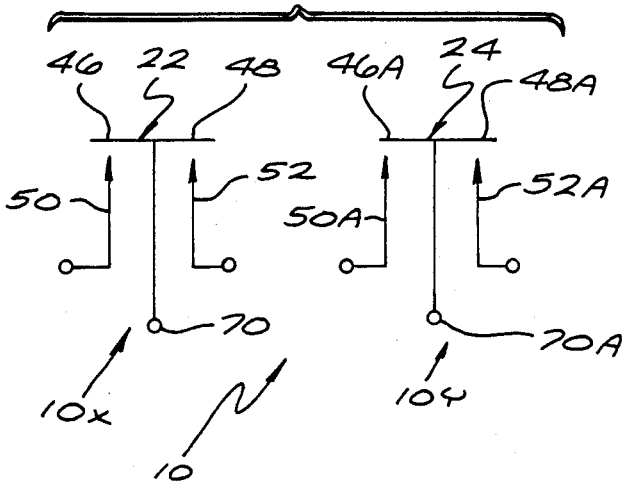
FIG. 9 is a schematic diagram of the switch of FIG. 2.

FIG. 9 is a schematic diagram of the switch 10 which includes switch portions 10X and 10Y, each with these terminals that are interconnected at two locations when the switch is closed. That is, switch 10X has a common switch contact 70 that connects to two other contacts 50, 52 when the switch is closed. Similarly, switch portion 10Y has a common switch contact at 70A that connects to switch contacts 50A, 52A when the switch is closed. The switch can be used in many ways, with perhaps the most common being to provide large redundancy, by connecting one terminal of a circuit to both common contacts 70, 70A, and other terminal of the circuit to the four contacts 50, 52, 50A and 52A. In another arrangement, the switch acts as two separate switches, each with two sets of contacts for redundancy to increase reliability.

Thus, the invention provides a multi-pole switch which is relatively simple and compact, which provides for a long travel of switching elements in moving between the open and closed condition, and which provides tactile feedback to the person operating the switch. The switch includes one, and preferably two shorting contacts, each with an outer region having opposite end portions that is held down to bow a beam connecting the end portions. The beam has fingers extending therefrom which press against the switch contacts when the beam is depressed. Each shorting contact preferably is of a largely rectangular loop shape, with a long side opposite the beam being upwardly bowed by a third switch contact. An actuator for moving down the fingers has bosses that press against locations on the beam on opposite sides of the middle of the beam. The bosses lie on a plunger which is depressed by a snapdome. The snapdome is covered by an elastomeric button which provides additional resistance to switch actuation and which provides a water resistant seal.

Although particular embodiments of the invention have been described and illustrated herein, it is recognized that modifications and variations may readily occur to those skilled in the art and consequently it is intended to cover such modifications and equivalents.

What is claimed is:

1. A switch comprising:

a housing;

a sheet first metal shorting contact having an outer region with first and second end portions, and a first beam having a middle portion and opposite ends whereby said opposite ends are coupled to said first and second portions and said first beam extends in a bowed configuration such that said middle portion lies above an imaginary line connecting said first and second end portions, said first beam having an upwardly bowed main beam portion located between said opposite ends and a pair of fingers extending from said main beam portion, said housing having support surfaces on which said contact outer region rests and a clamp which holds down said contact outer region against said support surfaces;

a pair of switch contacts, each lying under one of said fingers and spaced from the corresponding finger; an actuator first movably mounted at least partially within said housing and having a pair of bosses lying over locations on said first beam, which lie on opposite sides of said first beam middle, said actuator being depressible to depress said first beam locations that lie on opposite sides of said middle to move said fingers against said switch contacts.

2. The switch described in claim 1 wherein:

said outer region of said first shorting contact includes a second beam having opposite ends, said first and second end portions of said contact outer region connecting adjacent ends of said first and second beams; and a third switch contact lying under and against the middle of said second beam at a height above an imaginary line connecting the ends of said second beam, to upwardly bow the second beam and assure good contact between it and the third switch contact.

3. The switch described in claim 1 wherein:

each of said fingers has an inner end extending from a location on said first beam which is closer to a corresponding opposite end of the first beam than to the middle of the first beam, and each finger has an outer portion extending primarily parallel to said main beam portion towards the other finger.

4. The switch described in claim 3 wherein:

said first pair of bosses are positioned to press on positions on said main beam portions which are closer to said opposite beam ends than said first beam middle.

5. The switch described in claim 1 wherein:

said actuator includes a plunger having said first pair of bosses and having an upper end with a middle, a snapdome having a middle lying on said plunger middle and a peripheral portion resting on said housing, and a button lying over the middle of said snapdome and depressible to deform the snapdome and depress the plunger.

6. The switch described in claim 5 wherein:

said plunger has a top with an upwardly extending round boss nested in the bottom of said snapdome.

7. The switch described in claim 5 wherein:

said button comprises an elastomeric member with a middle portion lying over the middle of said snapdome and a flange lying around said middle portion;

said housing includes a lower housing portion which supports said shorting contact, an upper housing portion which supports said snapdome and the flange of said elastomeric button, and a retainer lying on said upper housing portion, said retainer compressing said flange of said elastomeric button against said upper housing portion.

8. The switch described in claim 1 including:

a second sheet metal shoring contact substantially identical to said first shorting contact and lying within the housing, substantially coplanar to said first shorting contact, said second contact having an outer region and a beam having a main beam portion and a pair of fingers;

a second pair of switch contacts, each lying under one of the fingers of said second shorting contact;

said actuator includes a plunger having said first pair of bosses and a second pair of bosses whereby the second pair of bosses lie over locations on said beam of said second contact.

9. A switch comprising:

a pair of sheet metal shorting contacts each extending in a loop and having first and second opposite sides and a pair of opposite end portions extending between said sides, said first side forming a beam having a main beam portion with opposite ends and a middle and said beam having a pair of fingers extending from said main beam portion;

said fingers of each shorting contact having inner ends extending from locations on said main beam portion which are closer to the ends of the main beam portion than to the middle thereof, and said fingers extend towards each other from their inner ends;

a housing having a lower housing portion with surfaces that support said end portions of said shorting contacts, and with clamps that hold down said contact end portions close to said surfaces at an orientation at which each end portion is inclined to hold said beam in an upwardly bowed configuration, a pair of switch contacts lying within said housing and under the pair of fingers of each shoring contact;

an actuator movably mounted at least partially within said housing and having a pair of bosses lying against locations on the main beam portion of each shorting contact on opposite sides of the middle of the beam portion.

10. The switch described in claim 9 including:

a pair of third switch contacts, each lying under the middle of the second side of one of side shorting contacts, said second side of each contact being upwardly bowed.

11. A switch comprising:

a first sheet metal shorting contact that includes an outer region having first and second end portions and that also includes a first beam extending between said end portions;

a housing that has a support surface that supports said end portions of said contact outer region, and that has clamps that hold down said contact end portions in a deformed state wherein said end portions hold said first beam in an upwardly bowed configuration;

at least one switch contact lying under said beam;

an actuator movably mounted at least partially within said housing and having a plunger with a pair of bosses lying on said first beam, a snapdome with a periphery lying in said housing and a center lying on said plunger, and an elastomeric button with a middle portion lying over the middle of said snapdome and a flange lying around said middle and held to said housing.

12. The switch described in claim 11 wherein:

said housing includes a surface that supports said flange of said elastomeric button and a retainer plate that lies over said flange of said button and that holds said flange in compression against the portion of said housing to which said flange is held.

13. The switch described in claim 11 wherein:

said plunger has an upstanding round boss at its top which is nested in the middle of said snapdome.

14. The switch described in claim 11 including:

a second shorting contact that is substantially the same as said first shorting contact, and lies within said housing substantially coplanar with said first shorting contact, and has a first beam extending parallel to the first beam of said first shorting contact;

said plunger bosses lie on the beam of said second shorting contact; and a second pair of switch contacts lying under said beam of said second shorting contact.

15. The switch described in claim 14 wherein:

the outer region of each of said shorting contacts includes a second beam extending largely parallel to the corresponding first beam, both first and second beams having opposite ends, said end portions of each shorting contact, each connecting the opposite ends of said first and second beams;

a pair of third switch contacts, each lying under the middle of the second beam of each of said shorting contacts, at an elevated height that upwardly bows the second beam.

* * * * *